US007528101B2

(12) United States Patent
Carvell et al.

(10) Patent No.: US 7,528,101 B2
(45) Date of Patent: May 5, 2009

(54) LAUNDRY TREATMENT COMPOSITIONS

(75) Inventors: Melvin Carvell, Wirral (GB); Paul Hugh Findlay, Wirral (GB); Christopher Clarkson Jones, Wirral (GB); Giovanni Francesco Unali, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 496 days.

(21) Appl. No.: 10/561,139

(22) PCT Filed: May 17, 2004

(86) PCT No.: PCT/EP2004/005275

§ 371 (c)(1),
(2), (4) Date: Dec. 16, 2005

(87) PCT Pub. No.: WO2004/111169

PCT Pub. Date: Dec. 23, 2004

(65) Prior Publication Data

US 2006/0143835 A1 Jul. 6, 2006

(30) Foreign Application Priority Data

Jun. 16, 2003 (GB) ..... 0313900.3

(51) Int. Cl.
*C11D 3/00* (2006.01)
*C11D 1/66* (2006.01)

(52) U.S. Cl. ..... 510/515; 510/470; 510/287; 510/276; 510/466

(58) Field of Classification Search ..... 510/515, 510/470, 473, 276, 466
See application file for complete search history.

(56) References Cited

U.S. PATENT DOCUMENTS

| | | | | |
|---|---|---|---|---|
| 6,248,710 | B1 * | 6/2001 | Bijsterbosch et al. | 510/470 |
| 6,251,850 | B1 * | 6/2001 | Clarke et al. | 510/527 |
| 6,398,911 | B1 | 6/2002 | Schroeder et al. | |
| 6,897,189 | B2 * | 5/2005 | Dupont et al. | 510/287 |
| 6,939,842 | B2 * | 9/2005 | Hunter et al. | 510/470 |
| 7,297,672 | B2 * | 11/2007 | Cooper et al. | 510/417 |
| 2004/0152621 | A1 * | 8/2004 | Carvell et al. | 510/516 |

FOREIGN PATENT DOCUMENTS

| | | |
|---|---|---|
| JP | 070268778 | 10/1995 |
| WO | 98/29528 | 7/1998 |
| WO | 99/36469 | 7/1999 |
| WO | 00/18861 | 4/2000 |
| WO | 03/014278 | 2/2003 |
| WO | 03/020770 | 3/2003 |
| WO | 03/020819 | 3/2003 |
| WO | 03/040279 | 5/2003 |
| WO | 03/050144 | 6/2003 |
| WO | 2004/050813 | 6/2004 |

OTHER PUBLICATIONS

European Search Report, EP 06 12 2248, dated Feb. 8, 2007, 2pp.
International Search Report, PCT/EP2004/005275, mailed Sep. 15, 2004, 3 pp.
GB Search Report, GB 0313900.3, dated Oct. 9, 2003, 1 p.

* cited by examiner

*Primary Examiner*—Mark Eashoo
*Assistant Examiner*—Jane L Stanley
(74) *Attorney, Agent, or Firm*—Alan A. Bornstein

(57) ABSTRACT

A water-soluble or dispersible, hydrolytically stable polysaccharide preferably selected from the group consisting of poly-glucan, poly-mannan, gluco-mannan and mixtures thereof. Which is covalently linked by a hydrolytically stable bond to a first polymeric textile softening species (typically a silicone) and optionally emulsified with a second polymeric textile softening species. The specification also discloses laundry treatment composition comprising these compositions.

20 Claims, No Drawings

LAUNDRY TREATMENT COMPOSITIONS

TECHNICAL FIELD

The present invention relates to polysaccharides of the kind comprising a benefit agent and to compositions containing the same. It also relates to a deposition aid for deposition of a further benefit agent onto a substrate. These compositions are suitable, for example, for use as laundry treatment compositions or as components thereof. The invention further relates to a method of depositing a benefit agent from solution or dispersion, onto a substrate by means of such a composition.

BACKGROUND OF THE INVENTION

The deposition of a benefit agent onto a substrate, such as a fabric, is well known in the laundry art. In laundry applications typical "benefit agents" include fabric softeners and conditioners, soil release polymers, sunscreens and the like. Deposition of a benefit agent is used, for example, in fabric treatment processes such as fabric softening to impart desirable properties to the fabric substrate.

Conventionally, the deposition of the benefit agent has had to rely upon the attractive forces between an oppositely charged substrate and a benefit agent. Typically, this requires the addition of benefit agents during the rinsing step of a for example a washing process so as to avoid adverse effects from other charged chemical species present in the treatment compositions. By way of illustration, cationic fabric conditioners are incompatible with anionic surfactants such as are used in laundry washing compositions.

Such 'adverse charge' considerations can place severe limitations upon the inclusion of benefit agents in compositions where an active component thereof is of an opposite charge to that of the benefit agent. For example, cotton is negatively charged and thus requires a positively charged benefit agent in order for the benefit agent to be substantive to the cotton, i.e. to have an affinity for the cotton so as to absorb onto it.

Often the substantivity of the benefit agent is reduced and/or the deposition rate of the material is reduced because of the presence of incompatible charged species in the compositions. However, in recent times, it has been proposed to deliver a benefit agent in a form whereby it is substituted onto another chemical moiety which increases the benefits agents affinity for the substrate in question.

Prior Art

It is known that cellulose is difficult to disperse in water. This is not due to the inherent insolubility of the material but rather due to the extremely good hydrogen bonding which cellulose exhibits against itself. Blocking some of hydrogen bonding sites, such as with ester or ether groups improves the solubility of cellulose.

WO 98/29528 discloses cellulose ethers in which some substituents are (poly)alkoxylated, analogues of the latter in which the (poly)alkoxylated groups are terminated with a cationic moiety in the form of a quaternary ammonium group, and cellulose ethers in which some substituents are carboxylic acids in the salt form the charged species assist in the interaction of the cellulose with the substrate.

WO 00/18861 provides a water-soluble or water-dispersible polysaccharide which comprises: a deposition enhancing part (the polymeric backbone—which in the case of cellulose shows self-recognition properties) and a benefit agent group attached to the deposition enhancing part by a hydrolytically stable bond. During a treatment process the material undergoes a chemical change which does not involve the hydrolytically stable bond but by which the affinity of the material onto the substrate is increased. A preferred material is cellulose mono acetate (CMA). This molecule has an affinity for cotton due to the self-recognition properties of cellulose and is soluble due to the presence of the acetate groups. The acetate groups hydrolyse in aqueous solution causing the deposited cellulose to remain on a cellulosic substrate. Manufacture of CMA involves excessive esterification of the —OH groups of the cellulose and then hydrolysis of some of the esters to attain the desired degree of esterification.

WO 03/020770 discloses a substituted $\beta_{1-4}$ linked polysaccharide such as cellulose mono-acetate with one or more independently selected silicone chains covalently attached to it as the benefit agent.

While the molecules of WO 03/020770 are relatively expensive, it has been found that the covalently-linked silicone chains may be used to emulsify droplets of a further portion of silicone to enhance the deposition of that material.

Our UK patent application no WO 03/020819 discloses a laundry treatment composition comprising a composition similar to that of WO 03/020770 in combination with a non-covalently bonded silicone which is, for example, emulsified in the same composition. This enables relatively large quantities of silicone to be deposited without an excessive on-cost for the formulator.

Despite the above-mentioned advances, the need remains to further improve upon deposition systems based on cellulose-recognition. It is advantageous to reduce cost, improve stability and/or increase efficacy, improve the sustainability or biodegradability of the material.

DEFINITION OF THE INVENTION

We have now determined that certain natural polysaccharides can be used as a surprisingly effective alternative to synthetic cellulose mono acetate in the deposition of benefit agents, particularly textile softening agents.

Accordingly, a first aspect of the present invention provides a water-soluble or dispersible, non-hydrolysable polysaccharide (NHP), having at least one first polymeric textile benefit species bonded thereto by a hydrolytically stable bond.

Preferably, the first polymeric textile benefit species is a first polymeric textile softening species (FPSS). While the invention is described below with particular reference to textile softening as the benefit obtained, other and broader aspects of the invention are not hereby excluded.

By water-soluble, as used herein, what is meant is that the material forms an isotropic solution on addition to water or another aqueous solution.

By water-dispersible, as used herein, what is meant is that the material forms a finely divided suspension on addition to water or another aqueous solution.

By non-hydrolysable polysaccharide is meant that the polysaccharide does not contain a deposition enhancing group which undergoes a chemical change under conditions (including temperature) of use to increase the affinity of the polysaccharide to a substrate. In those embodiments of the invention intended for aqueous treatment of substrates, such as, in a wash liquor, these conditions can include, elevated pH and/or temperatures above ambient.

By an increase in the affinity of the substituted polysaccharide for a substrate such as a textile fabric upon a chemical change, what is meant is that at some time during the treatment process, the amount of material that has been deposited is greater when the chemical change is occurring or has occurred, compared to when the chemical change has not occurred and is not occurring, or is occurring more slowly, the comparison being made with all conditions being equal except for that change in the conditions which is necessary to affect the rate of chemical change.

The FPSS is attached to the non-hydrolysable polysaccharide by a stable bond. That means that the bonding of the FPSS should be sufficiently stable so as not to undergo hydrolysis during processing or on storage prior to use or in the environment of the treatment process for the duration of that process. For example, in laundry cleaning applications, the FPSS-polysaccharide conjugate should be sufficiently stable so that the bond between the FPSS and polysaccharide does not undergo hydrolysis in the wash liquor, at the wash temperature, before the silicone has been deposited onto the fabric.

Preferably, the bond between the FPSS and the polysaccharide is such that the decay rate constant ($k_d$) of the material in an aqueous solution at 0.01 wt % of the material together with 0.1 wt % of anionic surfactant at a temperature of 40° C. at a pH of 10.5 is such that $k_d<10^{-3}s^{-1}$.

The hydrolytic stability of the molecule is advantageous in that it may be stored for extended periods without the requirement that it is protected from atmospheric or other ambient moisture. This is a distinct advantage over the prior art, wherein the deposition enhancing groups are inherently unstable.

Deposition onto a substrate includes deposition by adsorption, co-crystallisation, entrapment and/or adhesion.

Preferably, the NHP has a backbone comprising $\beta_{1-4}$ linkages. More preferably it is a poly-glucan, poly-mannan, or gluco-mannan and most preferably a galacto-mannan or xylo-glucan. Preferred polysaccharides are Locust Bean Gum, Tamarind xyloglucan, and guar gum. The most highly preferred polysaccharides are Locust Bean Gum and Tamarind xyloglucan. Mixtures of these polysaccharides may also be utilised.

Naturally occurring polysaccharides are preferred. These have the particular advantages, amongst others, that the esterification/de-esterification reaction used to prepare CMA is avoided, costs are generally lower and the materials have a high environmental compatibility.

The first polymeric textile softening species (FPSS) is preferably a silicone and more preferably an amino silicone.

While the invention will be described below with particular reference to the use of silicones as the softening species, other and broader aspects of the invention are not thereby excluded.

While a benefit can be obtained with the above-mentioned FPSS-NHP molecule per se, it is preferable that the molecule is used to aid the deposition of a further softening benefit agent.

Advantageously, the present invention further provides a composition comprising the composition of the first aspect of the invention (FPSS-NHP) in combination with a second textile benefit species which is not covalently bonded thereto.

Preferably the second textile benefit species is a second polymeric textile softening species (SPSS).

Preferably the SPSS is also a silicone, more preferably an amino-silicone, independently selected from the FPSS. Advantageously the SPSS is a hindered amine silicone. The preferred dynamic viscosity of the SPSS is >2,500 mPas (at a shear rate of around 100 reciprocal seconds and a temperature of 20° C.).

Preferably, the ratio of the NHP-FPSS conjugate to the SPSS is in the range 1:200 to 1:5 parts by weight. Most preferably around 1:20 to 1:10 parts by weight. For the sake of clarity, the NHP-FPSS conjugate is the NHP with the FPSS bonded thereto.

The invention further provides emulsions comprising NHP with FPSS bonded thereto (i.e. NHP-FPSS), and optionally SPSS, as a dispersed phase. Ideally, these emulsions may be dried or otherwise encapsulated, to provide a dispersible form of the compositions of the invention. The dispersible form can comprise an adjunct, preferably a granulate, suitable for inclusion in a laundry composition.

Fully formulated compositions according to the present invention preferably contain a surfactant (which may be nonionic, anionic, cationic, or a mixture of some or all thereof). Preferably the surfactant is a detersive surfactant, more preferably an anionic or nonionic surfactant or a mixture thereof.

Typically, the level of NHP-FPSS or NHP-FPSS plus SPSS in a fully formulated composition will be 0.001-25% wt on product.

Advantageously, the emulsion and/or granulate and/or fully formulated composition comprises a perfume. Inclusion of the perfume in the emulsion can be used to modify the viscosity of the emulsion components, making the emulsion easier to process. Moreover, delivery of the perfume may be enhanced by this mode of incorporation.

A further aspect of the present invention provides a method for depositing a silicone onto a substrate, the method comprising, contacting in an aqueous medium, the substrate and a composition according to the invention.

A yet further aspect of the invention provides the use of a composition according to the invention to enhance the softening benefit of a laundry treatment composition on a substrate

DETAILED DESCRIPTION OF THE INVENTION

As set out above, the polysaccharide of the present invention is water-soluble or water-dispersible in nature and preferably comprises a polysaccharide substituted with at least one silicone attached to the polysaccharide aid by a hydrolytically stable bond. As noted above, the optional, second polymeric softening species (SPSS) is also preferably a silicone. The invention will be described below in respect of various preferred features of those embodiments in which the FPSS and/or the SPSS is a silicone.

The Silicone:

Silicones are conventionally incorporated in laundry treatment (e.g. wash or rinse) compositions to endow antifoam, fabric softening, ease of ironing, anti-crease and other benefits. Any type of silicone can be used to impart the advantageous properties of the present invention however, some silicones and mixtures of silicones are more preferred.

Preferred inclusion levels are such that from 0.01% to 20%, preferably from 1% to 10% of total silicone by weight is present in the of the fully formulated composition. Some or all of this silicone is in the form of the conjugate, or non-bonded but associated silicone. Free silicone which is not associated with the polysaccharide can also be present.

Suitable silicones include:

- non-volatile silicone fluids, such as poly(di)alkyl siloxanes, especially polydimethyl siloxanes and carboxylated or ethoxylated variants. They may be branched, partially cross-linked or preferably linear.
- aminosilicones, comprising any organosilicone having amine functionality for example as disclosed in EP-A-459 821, EP-A-459 822 and WO 02/29152. They may be branched, partially cross-linked or preferably linear.

any organosilicone of formula H-SXC where SXC is any such group hereinafter defined, and derivatives thereof.

reactive silicones and phenyl silicones

Preferably, the FPSS is a silicone selected from polydialkyl siloxanes, amine derivatives thereof, and mixtures thereof.

The choice of molecular weight of the silicones is mainly determined by processability factors. However, the molecular weight of silicones is usually indicated by reference to the viscosity of the material. Preferably, the silicones are liquid and typically have a dynamic viscosity in the range 20 mPa s to 300,000 m Pa s when measured at 25° C. and a shear rate of around 100 $s^{-1}$.

Suitable silicones include dimethyl, methyl (aminoethylaminoisobutyl) siloxane, typically having a dynamic viscosity of from 100 mPas to 200 000 mPas (when measured at 25° C. and a shear rate of around 100 $s^{-1}$) with an average amine content of ca. 2 mol % and, for example, Rhodorsil Oil 21645, Rhodorsil Oil Extrasoft and Wacker Finish 1300.

More specifically, materials such as polyalkyl or polyaryl silicones with the following structure can be used:

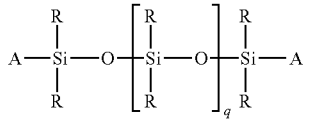

The alkyl or aryl groups substituted on the siloxane chain (R) or at the ends of the siloxane chains (A) can have any structure as long as the resulting silicones remain fluid at room temperature.

R preferably represents a phenyl, a hydroxy, an alkyl or an aryl group. The two R groups on the silicone atom can represent the same group or different groups. More preferably, the two R groups represent the same group preferably, a methyl, an ethyl, a propyl, a phenyl or a hydroxy group. "q" is preferably an integer from about 7 to about 8,000. "A" represents groups which block the ends of the silicone chains. Suitable A groups include hydrogen, methyl, methoxy, ethoxy, hydroxy, propoxy, and aryloxy.

Preferred alkylsiloxanes include polydimethyl siloxanes having a dynamic viscosity of greater than about 100 mPas at 25° C. and a shear rate of around 100$s^{-1}$.

Suitable methods for preparing these silicone materials are disclosed in U.S. Pat. No. 2,826,551 and U.S. Pat. No. 3,964,500.

Other useful silicone materials include materials of the formula:

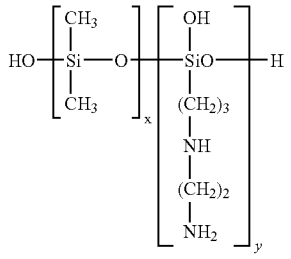

wherein x and y are integers which depend on the molecular weight of the silicone, the dynamic viscosity being from about 100 mPas to about 500,000 mPas at 25° C. and a shear rate of around 100$s^{-1}$. This material is also known as "amodimethicone".

Other silicone materials which can be used, correspond to the formulae:

$$(R^1)_aG_{3-a}\text{-Si}—(—OSiG_2)_n\text{-}(OSiG_b(R^1)_{2-b})_m—O—SiG_{3-a}(R^1)_a$$

wherein G is selected from the group consisting of hydrogen, phenyl, OH, and/or $C_{1-8}$ alkyl; a denotes 0 or an integer from 1 to 3; b denotes 0 or 1; the sum of n+m is a number from 1 to about 2,000; $R^1$ is a monovalent radical of formula $CpH_2pL$ in which p is an integer from 2 to 8 and L is selected from the group consisting of $$—N(R^2)CH_2—CH_2—N(R^2)_2;$$

$$—N(R^2)_2;$$

$$—N^+(R^2)_3A^-; \text{ and}$$

$$—N^+(R^2)CH_2—CH_2N^+H_2A^-$$

wherein each $R^2$ is chosen from the group consisting of hydrogen, phenyl, benzyl, a saturated hydrocarbon radical, and each $A^-$ denotes a compatible anion, e.g. a halide ion; and

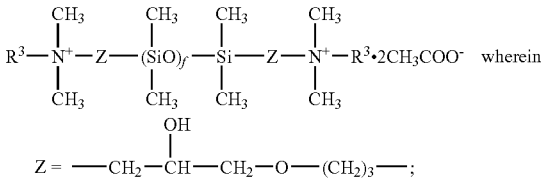

$R^3$ denotes a long chain alkyl group; and f denotes an integer of at least about 2.

Another silicone material which can be used, has the formula:

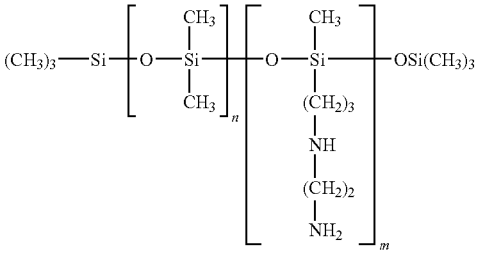

wherein n and m are the same as before.

Other suitable silicones comprise linear, cyclic, or three-dimensional polyorganosiloxanes of formula (I)

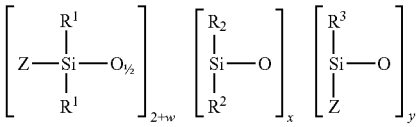

(I)

-continued

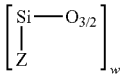

wherein (1) the symbols Z are identical or different, represent $R^1$, and/or V;

(2) $R^1$, $R^2$ and $R^3$ are identical or different and represent a monovalent hydrocarbon radical chosen from the linear or branched alkyl radicals having 1 to 4 carbon atoms, the linear or branched alkoxy radicals having 1 to 4 carbon atoms, a phenyl radical, preferably a hydroxy radical, an ethoxy radical, a methoxy radical or a methyl radical; and (3) the symbols V represent a group of sterically hindered piperidinyl functions chosen from (II)

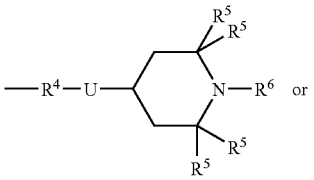

or (III)

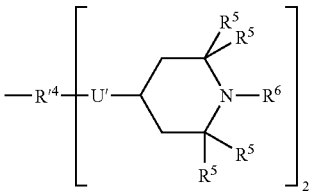

For the groups of formula II (II)

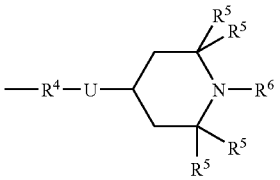

$R^4$ is a divalent hydrocarbon radical chosen from linear or branched alkylene radical, having 2 to 18 carbon atoms;

linear or branched alkylene-carbonyl radical where the alkylene part is linear or branched, comprising 2 to 20 carbon atoms;

linear or branched alkylene-cycolhexylene where the alkylene part is linear or branched, comprising 2 to 12 carbon atoms and the cyclohexylene comprises an OH group and possibly 1 or 2 alkyl radicals having 1 to 4 carbon atoms;

the radicals of the formula $—R^7—O—R^7$ where the $R^7$ radical is identical or different represents an alkylene radical having 1 to 12 carbon atoms;

the radicals of the formula $—R^7—O—R^7$ where the $R^7$ radical is as indicated previously and one or both are substituted by one or two OH groups;

the radicals of the formula $—R^7—COO—R^7$ where the $—R^7$ radicals are as indicated previously;

the radicals of formula $R^8—O—R^9—O—CO—R^8$ where the $R^8$ and $R^9$ radicals are identical or different, represent alkylene radicals and have 2 to 12 carbon atoms and the radical $R^9$ is possibly substituted with a hydroxyl radical;

U represents —O— or $—NR^{10}—$, $R^{10}$ is a radical chosen from a hydrogen atom, a linear or branched alkyl radical comprising 1 to 6 carbon atoms and a divalent radical of the formula:

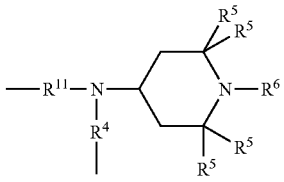

where $R^4$ is as indicated previously, $R^5$ and $R^6$ have the meaning indicated below et $R^{11}$ represents a divalent alkylene radical, linear or branched, having 1 to 12 carbon atoms, one of the valent bonds (one of $R^{11}$) is connected to an atom of $—NR^{10}—$, the other (one of $R^4$) is connected to a silicone atom;

the radical $R^5$ is identical or different, chosen from the linear or branched alkyl radicals having 1 to 3 carbon atoms and the phenyl radical;

the radical $R^6$ represents a hydrogen radical or the $R^5$ radical or O.

For the groups of formula (III):

(III)

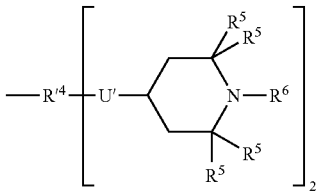

$R'^4$ is chosen from a trivalent radical of the formula:

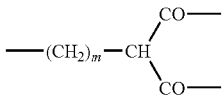

where m represents a number between 2 and 20, and a trivalent radical of the formula:

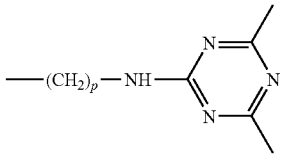

where p represents a number between 2 and 20;

U represents —O— or $NR^{12}$, $R^{12}$ is a radical chosen from a hydrogen atom, a linear or branched alkyl radical comprising 1 to 6 carbon atoms;

$R^5$ and $R^6$ have the same meaning as proposed for formula (II); and (4)—the number of units nSi without group V comprises between 10 and 450 the number of units nSi with group V comprises between 1 and 5, $0 \leqq w \leqq 10$ and $8 \leqq y \leqq 448$.

The Polysaccharide Part

The hydrolytically-stable polysaccharide is preferably a $\beta$-$_{1,4}$-linked polysaccharide having an affinity for cellulose.

The polysaccharide may be straight or branched. Many naturally occurring polysaccharides have at least some degree of branching, or at any rate at least some saccharide rings are in the form of pendant side groups on a main polysaccharide backbone.

A polysaccharide comprises a plurality of saccharide rings which have pendant hydroxyl groups. In the preferred polysaccharides of the present invention, at least some of these hydroxyl groups are independently substituted by, or replaced with, one or more other substituents, at least one being a silicone chain as FPSS. The "average degree of substitution" for a given class of substituent means the average number of substituents of that class per saccharide ring for the totality of polysaccharide molecules in the sample and is determined for all saccharide rings.

The polysaccharide is not cellulose or a hydrolytically-stable modified cellulose as, while cellulose displays excellent self recognition, it is of poor solubility.

Silicone Chain(s) as FPSS

As used herein the term "silicone chain" means a polysiloxane or derivative thereof.

In this specification the "n" subscript used in the general formulae of the substituted polysaccharide is a generic reference to a polymer. Although "n" can also mean the actual (average) number of repeat units present in the polysaccharide, it is more meaningful to refer to "n" by the number average molecular weight.

The number average molecular weight ($M_n$) of the substituted polysaccharide part may typically be in the range of 1,000 to 200,000, for example 2,000 to 100,000, e.g. as measured using GPC with multiple-angle, laser-scattering detection.

Preferably, the average degree of substitution for the silicone chains on the polysaccharide backbone is from 0.00001 to 0.5, preferably from 0.001 to 0.5, more preferably from 0.001 to 0.1. A further preferred range is from 0.01 to 0.05.

Preferred silicone chains suitable for this use are those of formula:

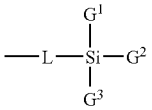

wherein L is absent or is a linking group and one or two of substituents $G^1$-$G^3$ is a methyl group, the remainder being selected from groups of formula

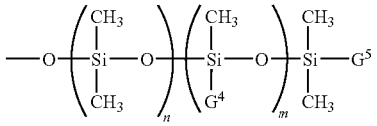

the —$Si(CH_3)_2O$— groups and the —$Si(CH_30)(G^4)$- groups being arranged in random or block fashion, but preferably random.

wherein n is from 5 to 1000, preferably from 10 to 200 and m is from 0 to 100, preferably from 0 to 20, for example from 1 to 20.

$G^4$ is selected from groups of formula:

—$(CH_2)_p$—$CH_3$, where p is from 1 to 18

—$(CH_2)_q$—NH—$(CH_2)_r$, —$NH_2$ where q and r are independently from 1 to 3

—$(CH_2)_s$—$NH_2$, where s is from 1 to 3

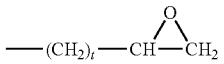

where t is from 1 to 3

—$(CH_2)_u$—COOH, where u is from 1 to 10,

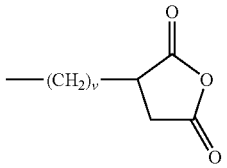

where v is from 1 to 10, and

—$(CH_2CH_2O)_w$—$(CH_2)_xH$, where w is from 1 to 150, preferably from 10 to 20 and x is from 0 to 10;

and $G^5$ is independently selected from hydrogen, groups defined above for $G^4$, —OH, —$CH_3$ and —$C(CH_3)_3$.

L may be selected from amide linkages, ester linkages, ether linkages, urethane linkages, triazine linkages, carbonate linkages, amine linkages and ester-alkylene linkages.

Other Substituents

As well as the FPSS, pendant groups of other types may optionally be present, i.e. groups which do not confer a softening benefit and which do not undergo a chemical change to enhance substrate affinity. Within that class of other groups is the sub-class of groups for enhancing the solubility of the material (e.g. groups which are, or contain one or more free carboxylic acid/salt and/or sulphonic acid/salt and/or sulphate groups).

Examples of solubility enhancing substituents include carboxyl, sulphonyl, hydroxyl, (poly)ethyleneoxy- and/or (poly) propyleneoxy-containing groups, as well as amine groups.

The other pendant groups preferably comprise from 0% to 65%, more preferably from 0% to 10% of the total number of pendant groups. The water-solubilising groups could comprise from 0% to 100% of those other groups but preferably from 0% to 20%, more preferably from 0% to 10%, still more preferably from 0% to 5% of the total number of other pendant groups.

It is preferable that the polysaccharide has no pendant groups other that those which are naturally present. Unlike cellulose mono-acetate, the polysaccharide is free of hydrolytically releasable esterified pendant groups (i.e. the acetate groups in CMA).

The preferred polysaccharides (locust bean gum, for example) have pendant galactose or other sugar residues which make them effectively more water dispersible/soluble than unmodified cellulose, but which are not hydrolysed from the backbone under conditions of use.

Synthetic Routes

Silicone chains as FPSS are preferably attached via a linking group "-L-". This linking group is the residue of the reactants used to form the FPSS-polysaccharide conjugate.

For silicone chains as FPSS, one or more hydroxyl groups on the polysaccharide are reacted with a reactive group attached to the silicone chain, or the hydroxyl group(s) in question is/are converted to another group capable of reaction with a reactive group attached to the silicone chain.

Listed below, are suitable mutually reactive groups. In the case of hydroxyl groups, these may be the original hydroxyl group of the polysaccharide. However, either of a pair of these mutually reactive groups may be present on the polysaccharide and the other attached to the silicone chain, or vice versa, the reaction chemistry being chosen appropriately. In the following description, for convenience, "PSC" refers to the polysaccharide chain with or without deposition enhancing group(s) and/or other substituent(s) already attached. "SXC" refers to the group as hereinbefore defined.

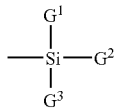

Preferred linking groups -L- are selected from the following, wherein preferably, the left hand end of the group depicted is connected to the saccharide ring either direct or via the residual oxygen of one of the original saccharide —OH groups and the right hand end is connected to the moiety —Si($G^1G^2G^3$). Thus, the configuration as written is PSC-L-SXC. However, the reverse configuration SXC-L-PSC is also within the ambit of this definition and this is also mentioned where appropriate.

Preferred linking groups -L- are selected from amide, ester, ether, urethane, triazine, carbonate, amine and ester-alkylene linkages.

A preferred amide linkage is:

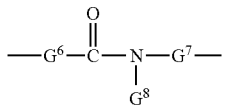

where $G^6$ and $G^7$ are each optionally present and are independently selected spacer groups, e.g. selected from $C_{1-14}$ alkylene groups, arylene, $C_{1-4}$ alkoxylene, a residue of an oligo- or poly-ethylene oxide moiety, $C_{1-4}$ alkylamine or a polyamine groups and $G^8$ is hydrogen or $C_{1-4}$ alkyl.

This linkage can be formed by reacting

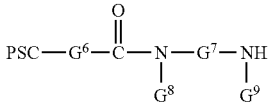

wherein $G^7$ and $G^8$ are as hereinbefore defined and $G^9$ is hydrogen or $C_{1-4}$ alkyl;

with a compound of formula:

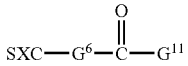

wherein $G^{11}$ is hydroxy, a group with active ester functionality halo, or a leaving group suitable for neucleophilie displacement such as imidazole or an imidazole-containing group and wherein $G^6$ is hereinbefore defined above, or —CO-$G^{11}$ is replaced by a cyclic acid anhydride. Active ester synthesis is described in M. Bodanszky, "The Peptides", Vol. 1, Academic Press Inc., 1975, pp 105 ff.

The reverse configuration linkage may be formed by reacting

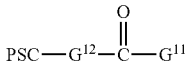

wherein $G^{12}$ is a ring-opened carboxylic acid anhydride, phenylene, or a group of formula

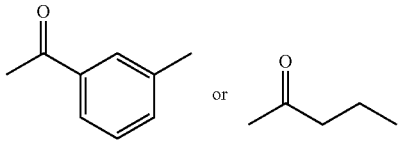

and $G^{11}$ is as hereinbefore defined;

with the group of formula

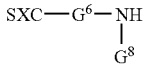

where $G^6$ and $G^8$ are as hereinbefore defined.

A preferred ester linkage has the formula

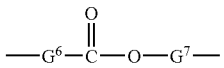

wherein $G^6$ and $G^7$ are as hereinbefore defined, $G^6$ optionally being absent.

This may be formed by reacting

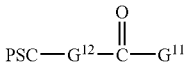

wherein $G^{11}$ and $G^{12}$ are as hereinbefore defined with

SXC-$G^6$-OH wherein $G^6$ is as hereinbefore defined.

The reverse ester linkage formation may be formed by reacting

PSC-$G^7$-OH (i.e. the optionally modified polysacharide with at least one residual —OH group)

with

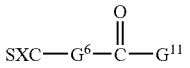

wherein $G^6$ and $G^{11}$ are as hereinbefore defined, or —CO-$G^{11}$ may be replaced by a cyclic anhydride.

Preferred ether linkages have the formula

-$G^6$-O-$G^7$ wherein $G^6$ and $G^7$ are as hereinbefore defined, optionally one being absent.

This linkage may be formed by reacting

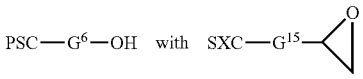

wherein $G^{15}$ is $C_{1-4}$ alkylene and $G^6$ is optionally absent and is as hereinbefore defined.

A preferred urethane linkage is

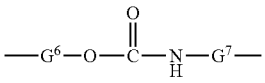

wherein $G^6$ and $G^7$ are as hereinbefore defined, $G^6$ optionally being absent (preferably absent in the configuration PSC-L-SXC)

PSC-$G^6$-OH with

SXC-$G^7$-NCO wherein $G^6$ and $G^7$ are as hereinbefore defined, $G^6$ optionally being absent (preferably absent in the configuration PSC-L-SXC).

The reverse configuration is also possible but the simplest arrangement is PSC-L-SXC and wherein $G^6$ is absent. Also most common is when $G^7$ is alkylene.

The latter compound is made by reacting

SXC-$G^7$-$NH_2$ (wherein $G^7$ is as hereinbefore defined) with phosgene.

Another route is to react

PSC-$G^6$-OH wherein $G^6$ is as hereinbefore defined with carbonyl dimidazole to form

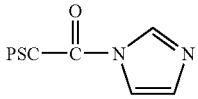

and react that product with

SXC-$G^7$-$NH_2$ wherein $G^7$ is as hereinbefore defined.

Preferred triazine linkages have the formula

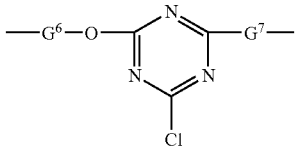

wherein $G^6$ and $G^7$ are as hereinbefore defined, $G^6$ optionally being absent.

These linkages may be formed by reacting

SXC-$G^7$-OH or

SXC-$G^7$-$NH_2$ wherein $G^7$ is as hereinbefore defined with cyanuic chloride and then with

PSC-$G^6$-OH wherein $G^6$ is as hereinbefore defined but may be absent; or (reverse -L-) by reacting

PSC-$G^7$-OH with cyanuric chloride (when $G^7$ is as hereinbefore defined) and then with

SXC-$G^6$-OH or

SXC-$G^6$-$NH_2$

Preferred carbonate linkages have the formula

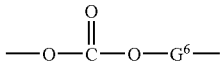

wherein $G^6$ is as hereinbefore defined.

This linkage may be formed by reacting

PSC-OH with

SXC-$G^6$-OH in the presence of carbonyl dimidazole or phosgene

Preferred amine linkages have the formula

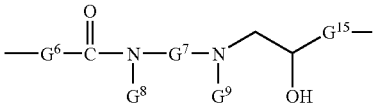

wherein $G^6$, $G^7$, $G^8$, $G^9$ and $G^{15}$ are as hereinbefore defined.

This linkage may be formed by reacting

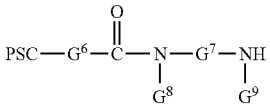

wherein $G^6$-$G^9$ are hereinbefore defined;

with

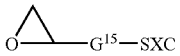

wherein $G^{15}$ is as hereinbefore defined.

Preferred ester-alkylene linkages have the formula

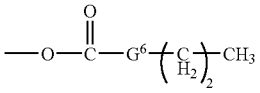

wherein $G^7$ is as hereinbefore defined.

These linkages may be prepared by reacting

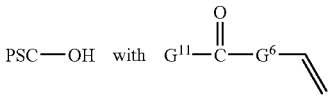

and then reacting with a hydrogen-terminated silicone chain compound (i.e. $G^5$=H) over a platinum catalyst.

Emulsions

Compositions according to the present invention can be provided in the form of an emulsion for use in laundry or other fabric treatment compositions.

Preferably, an emulsion according to the invention comprises the SPSS (preferably silicone) and a FPSS-polysaccharide conjugate as described above.

The emulsions must contain another liquid component as well as the SPSS, preferably a polar solvent, such as water. The emulsion has typically 30 to 99.9%, preferably 40 to 99% of the other liquid component (e.g. water). Low water emulsions may be for example 30 to 60% water, preferably 40 to 55% water. High water emulsions may be for example 60 to 99.9% water, preferably 80 to 99% water. Moderate water emulsions may be for example 55 to 80% water.

The emulsion may contain an emulsifying agent, preferably an emulsifying surfactant for the SPSS and FPSS-polysaccharide conjugate. In preferred cases, the FPSS-polysaccharide complex is itself an emulsifying agent.

The emulsifying agent is especially one or more surfactants, for example, selected from any class, sub class or specific surfactant(s) disclosed herein in any context.

The emulsifying agent most preferably comprises or consists of a non-ionic surfactant. Additionally or alternatively, one or more selected additional surfactants from anionic, cationic, zwitterionic and amphoteric surfactants may be incorporated in or used as the emulsifying agent.

Suitable non-ionic surfactants include the (poly)-alkoxylated analogues of saturated or unsaturated fatty alcohols, for example, having from 8 to 22, preferably from 9 to 18, more preferably from 10 to 15 carbon atoms on average in the hydrocarbon chain thereof and preferably on average from 3 to 11, more preferably from 4 to 9 alkyleneoxy groups. Most preferably, the alkyleneoxy groups are independently selected from ethyleneoxy, propyleneoxy and butylenoxy, especially ethyleneoxy and propylenoxy, or solely ethyleneoxy groups and alkyl polyglucosides as disclosed in EP 0 495 176.

Preferably, the (poly)alkoxylated analogues of saturated or unsaturated fatty alcohols, have a hydrophilic-lipophilic balance (HLB) of between 8 to 18.

The HLB of a polyethoxylated primary alcohol nonionic surfactant can be calculated by $$HLB = \frac{\mathrm{MW}(EO)}{\mathrm{MW}(TOT)\times 5}\times 100$$

where

MW (EO)=the molecular weight of the hydrophilic part (based on the average number of EO groups)

MW(TOT)=the molecular weight of the whole surfactant (based on the average chain length of the hydrocarbon chain)

This is the classical HLB calculation according to Griffin (J. Soc. Cosmetic Chemists, 5 (1954) 249-256).

For analogous nonionics with a mix of ethyleneoxy (EO), propylenoxy (PO) and/or butyleneoxy (BO) hydrophilic groups, the following formula can be used;

$$HLB = \frac{\mathrm{MW}(EO) + 0.57\ \mathrm{MW}(PO) + 0.4\ \mathrm{MW}(BO)}{\mathrm{MW}(TOT)\times 5}$$

Preferably, the alkyl polyglucosides may have the following formula;

$R—O-Z_n$ in which R is a linear or branched, saturated or unsaturated aliphatic alkyl radical having 8 to 18 carbon atoms or mixtures thereof, and $Z_n$ is a polyglycosyl radical with n=1.0 to 1.4 hexose or pentose units or mixtures. Preferred examples of alkylpolyglucosides include Glucopon™.

In a composition of a component (especially an emulsion) to be incorporated in a laundry treatment composition as a whole, the weight ratio of FPSS-polysaccharide conjugate to emulsifying agent (other than SPSS) is from 1:30 to 100:1, preferably 1:5 to 10:1. It should be noted that the FPSS-polysaccharide conjugate is frequently not a pure material due to incomplete conversion and the ratio of the material as made to the emulsifying agent is typically around 3:1

Further, in any such composition (especially emulsion components) the weight ratio of SPSS to emulsifying agent is from 100:1 to 2:1, preferably from 60:1 to 5:1, more preferably around 33:1.

Preferably, the total amount of SPSS is from 50 to 95%, preferably from 60 to 90%, more preferably from 70 to 85% by weight of the FPSS-polysaccharide conjugate, SPSS and any emulsifying agent (excluding the other liquid components).

Emulsion Processing

When in the form of an emulsion, the emulsion is prepared by mixing the SPSS, FPSS-polysaccharide conjugate, other liquid component (e.g. water) and preferably, also an emulsifying agent, such as a surfactant, especially a non-ionic surfactant, e.g. in a high shear mixer.

Whether or not pre-emulsified, the SPSS and the FPSS-polysaccharide conjugate may be incorporated by admixture with other components of a laundry treatment composition.

Laundry Treatment Compositions

A particularly preferred embodiment of the invention subsists in a laundry treatment composition comprising:

a) 1-60% wt of a surfactant, and b) 0.001-25% wt of a mixture comprising 1) a water-soluble or dispersible, non-hydrolysable polysaccharide selected from the group consisting of poly-glucan, poly-mannan, gluco-mannan and mixtures thereof, said polysaccharide being covalently linked by a hydrolytically stable bond to a first polymeric textile softening (FPSS) species, and, 2) optionally, a second polymeric textile softening (SPSS) species.

Preferably, SPSS is present and is emulsified with the FPSS-polsaccharide conjugate.

The FPSS-polysaccharide conjugate, and any optional SPSS, are incorporated together into laundry compositions, as separate ingredients or a composition which is an ingredient to be incorporated in the laundry treatment composition. As noted above, it is particularly preferred that conjugate/SPSS composition is an emulsion. Such a composition (whether an emulsion or not) may optionally also comprise only a diluent (which may comprise solid and/or liquid) and/or also it may comprise an active ingredient.

The FPSS-polysaccharide conjugate is typically included in said compositions at levels of from 0.001% to 10% by weight, preferably from 0.005% to 5%, most preferably from 0.01% to 3%.

If an emulsion is employed, typical inclusion levels of the emulsion in the laundry treatment composition are from 0.01 to 40%, more preferably from 0.001 to 30%, even more preferably from 0.1 to 20%, especially from 1 to 10% by weight of the total composition.

The active ingredient in the compositions is preferably a surface active agent or a fabric conditioning agent. More than one active ingredient may be included. For some applications a mixture of active ingredients may be used.

The compositions of the invention may be in any physical form e.g. a solid such as a powder or granules, a tablet, a solid bar, a paste, gel or liquid, especially, an aqueous based liquid. In particular the compositions may be used in laundry compositions, especially in liquid, powder or tablet laundry composition.

The compositions of the present invention are preferably laundry compositions, especially main wash (fabric washing) compositions or rinse-added softening compositions. The main wash compositions may include a fabric softening agent and rinse-added fabric softening compositions may include surface-active compounds, particularly non-ionic surface-active compounds, if appropriate.

The detergent compositions of the invention may contain a surface-active compound (surfactant) which may be chosen from soap and non-soap anionic, cationic, non-ionic, amphoteric and zwitterionic surface-active compounds and mixtures thereof. Many suitable surface-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic and non-ionic compounds.

The compositions of the invention may contain linear alkylbenzene sulphonate, particularly linear alkylbenzene sulphonates having an alkyl chain length of $C_8$-$C_{15}$. It is preferred if the level of linear alkylbenzene sulphonate is from 0 wt % to 30 wt %, more preferably 1 wt % to 25 wt %, most preferably from 2 wt % to 15 wt %.

The compositions of the invention may contain other anionic surfactants in amounts additional to the percentages quoted above. Suitable anionic surfactants are well-known to those skilled in the art. Examples include primary and secondary alkyl sulphates, particularly $C_8$-$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

The compositions of the invention may also contain non-ionic surfactant. Nonionic surfactants that may be used include the primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkyl-polyglycosides, glycerol monoethers, and polyhydroxyamides (glucamide).

It is preferred if the level of nonionic surfactant is from 0 wt % to 30 wt %, preferably from 1 wt % to 25 wt %, most preferably from 2 wt % to 15 wt %.

Although the preferred embodiments of the present invention include those in which the textile benefit species associated with the polysaccharide is a conditioning and or softening species, any conventional fabric conditioning agent may also be used in the compositions of the present invention. The conditioning agents may be cationic or non-ionic.

If the conventional fabric conditioning compound is to be employed in a main wash detergent composition comprising the polysaccharides of the present invention, the conventional fabric conditioning compound will typically be non-ionic. For use in the rinse phase, the any non-polysaccharide conditioner will typically be cationic. These may for example be used in amounts from 0.5% to 35%, preferably from 1% to 30% more preferably from 3% to 25% by weight of the composition.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions. Other examples of these cationic compounds are to be found in "Surfactants Science Series" volume 34 ed. Richmond 1990, volume 37 ed. Rubingh 1991 and volume 53 eds. Cross and Singer 1994, Marcel Dekker Inc. New York".

Any of the conventional types of such compounds may be used in the compositions of the present invention.

The fabric softening compounds are preferably compounds that provide excellent softening, and are characterised by a chain melting $L_\beta$ to $L_\alpha$ transition temperature greater than 25° C., preferably greater than 35° C., most preferably greater than 45° C. This $L_\beta$ to $L_\alpha$ transition can be measured by differential scanning calorimetry as defined in "Handbook of Lipid Bilayers", D Marsh, CRC Press, Boca Raton, Fla., 1990 (pages 137 and 337).

Substantially water-insoluble fabric softening compounds are defined as fabric softening compounds having a solubility of less than $1\times10^{-3}$ wt % in demineralised water at 20° C. Preferably the fabric softening compounds have a solubility of less than $1\times10^{-4}$ wt %, more preferably less than $1\times10^{-8}$ to $1\times10^{-6}$ wt %.

Especially preferred are cationic fabric softening compounds that are water-insoluble quaternary ammonium materials having two $C_{12-22}$ alkyl or alkenyl groups connected to the molecule via at least one ester link, preferably two ester links. An especially preferred ester-linked quaternary ammonium material can be represented by the formula:

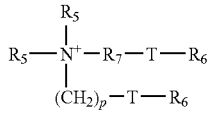

wherein each $R_5$ group is independently selected from $C_{1-4}$ alkyl or hydroxyalkyl groups or $C_{2-4}$ alkenyl groups; each $R_6$ group is independently selected from $C_{8-28}$ alkyl or alkenyl groups; and wherein $R_7$ is a linear or branched alkylene group of 1 to 5 carbon atoms, T is

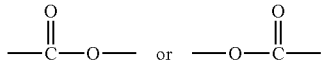

and p is 0 or is an integer from 1 to 5.

Di(tallowoxyloxyethyl) dimethyl ammonium chloride and/or its hardened tallow analogue is an especially preferred compound of this formula.

A second preferred type of quaternary ammonium material can be represented by the formula:

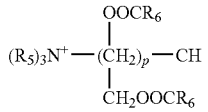

wherein $R_5$, p and $R_6$ are as defined above.

A third preferred type of quaternary ammonium material are those derived from triethanolamine (hereinafter referred to as 'TEA quats') as described in for example U.S. Pat. No. 3,915,867 and represented by formula:

$$(TOCH_2CH_2)_3N{+}(R_9)$$

wherein T is H or ($R_8$—CO—) where $R_8$ group is independently selected from $C_{8-28}$ alkyl or alkenyl groups and $R_9$ is $C_{1-4}$ alkyl or hydroxyalkyl groups or $C_{2-4}$ alkenyl groups. For example N-methyl-N,N,N-triethanolamine ditallowester or di-hardened-tallowester quaternary ammonium chloride or methosulphate. Examples of commercially available TEA quats include Rewoquat WE18 and Rewoquat WE20, both partially unsaturated (ex. WITCO), Tetranyl AOT-1, fully saturated (ex. KAO) and Stepantex VP 85, fully saturated (ex. Stepan).

It is advantageous if the quaternary ammonium material is biologically biodegradable.

Preferred materials of this class such as 1,2-bis(hardened tallowoyloxy)-3-trimethylammonium propane chloride and their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic fabric softeners, as described in GB 2 039 556B (Unilever).

The compositions may comprise a cationic fabric softening compound and an oil, for example as disclosed in EP-A-0829531.

The compositions may alternatively or additionally contain nonionic fabric softening agents such as lanolin and derivatives thereof.

Lecithins and other phospholipids are also suitable softening compounds.

In fabric softening compositions nonionic stabilising agent may be present. Suitable nonionic stabilising agents may be present such as linear $C_8$ to $C_{22}$ alcohols alkoxylated with 10 to 20 moles of alkylene oxide, $C_{10}$ to $C_{20}$ alcohols, or mixtures thereof. Other stabilising agents include the deflocculating polymers as described in EP 0415698A2 and EP 0458599 B1.

Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular, hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

It is also possible to include certain mono-alkyl cationic surfactants which can be used in main-wash compositions for fabrics. Cationic surfactants that may be used include quaternary ammonium salts of the general formula $R_1R_2R_3R_4N^+X^-$ wherein the R groups are long or short hydrocarbon chains, typically alkyl, hydroxyalkyl or ethoxylated alkyl groups, and X is a counter-ion (for example, compounds in which $R_1$ is a $C_8$-$C_{22}$ alkyl group, preferably a $C_8$-$C_{10}$ or $C_{12}$-$C_{14}$ alkyl group, $R_2$ is a methyl group, and $R_3$ and $R_4$, which may be the same or different, are methyl or hydroxyethyl groups); and cationic esters (for example, chorines esters).

The choice of surface-active compound (surfactant), and the amount present, will depend on the intended use of the detergent composition. In fabric washing compositions, different surfactant systems may be chosen, as is well known to the skilled formulator, for hand-washing products and for products intended for use in different types of washing machine.

The total amount of surfactant present will also depend on the intended end use and may be as high as 60 wt %, for example, in a composition for washing fabrics by hand. In compositions for machine washing of fabrics, an amount of from 5 to 40 wt % is generally appropriate. Typically the compositions will comprise at least 2 wt % surfactant e.g. 2-60%, preferably 15-40% most preferably 25-35%.

Detergent compositions suitable for use in most automatic fabric washing machines generally contain anionic non-soap surfactant, or non-ionic surfactant, or combinations of the two in any suitable ratio, optionally together with soap.

The compositions of the invention, when used as main wash fabric washing compositions, will generally also contain one or more detergency builders. The total amount of detergency builder in the compositions will typically range from 5 to 80 wt %, preferably from 10 to 60 wt %.

Inorganic builders that may be present include sodium carbonate, if desired in combination with a crystallisation seed for calcium carbonate, as disclosed in GB 1 437 950 (Unilever); crystalline and amorphous aluminosilicates, for example, zeolites as disclosed in GB 1 473 201 (Henkel), amorphous aluminosilicates as disclosed in GB 1 473 202 (Henkel) and mixed crystalline/amorphous aluminosilicates as disclosed in GB 1 470 250 (Procter & Gamble); and layered silicates as disclosed in EP 164 514B (Hoechst). Inorganic phosphate builders, for example, sodium orthophosphate, pyrophosphate and tripolyphosphate are also suitable for use with this invention.

The compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %.

The alkali metal aluminosilicate may be either crystalline or amorphous or mixtures thereof, having the general formula: 0.8-1.5 $Na_2O$. $Al_2O_3$. 0.8-6 $SiO_2$ These materials contain some bound water and are required to have a calcium ion exchange capacity of at least 50 mg CaO/g. The preferred sodium aluminosilicates contain 1.5-3.5 $SiO_2$ units (in the formula above). Both the amorphous and the crystalline materials can be prepared readily by reaction between sodium silicate and sodium aluminate, as amply described in the literature. Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal aluminosilicate of the zeolite P type having a silicon to aluminium weight ratio not exceeding 1.33, preferably within the range of from 0.90 to 1.33, and more preferably within the range of from 0.90 to 1.20.

Especially preferred is zeolite MAP having a silicon to aluminium weight ratio not exceeding 1.07, more preferably about 1.00. The calcium binding capacity of zeolite MAP is generally at least 150 mg CaO per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di and trisuccinates, carboxymethyloxy succinates, carboxymethyloxymalonates, dipicolinates, hydroxyethyliminodiacetates, alkyl- and alkenylmalonates and succinates; and sulphonated fatty acid salts. This list is not intended to be exhaustive.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Compositions according to the invention may also suitably contain a bleach system. Fabric washing compositions may desirably contain peroxy bleach compounds, for example, inorganic persalts or organic peroxy acids, capable of yielding hydrogen peroxide in aqueous solution.

Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate.

Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 0.1 to 35 wt %, preferably from 0.5 to 25 wt %. The peroxy bleach compound may be used in conjunction with a bleach activator (bleach precursor) to improve bleaching action at low wash temperatures. The bleach precursor is suitably present in an amount of from 0.1 to 8 wt %, preferably from 0.5 to 5 wt %.

Preferred bleach precursors are peroxycarboxylic acid precursors, more especially peracetic acid precursors and pernoanoic acid precursors. Especially preferred bleach precursors suitable for use in the present invention are N,N,N',N',-tetracetyl ethylenediamine (TAED) and sodium nonanoyloxybenzene sulphonate (SNOBS). The novel quaternary ammonium and phosphonium bleach precursors disclosed in U.S. Pat. No. 4,751,015 and U.S. Pat. No. 4,818,426 (Lever Brothers Company) and EP 402 971A (Unilever), and the cationic bleach precursors disclosed in EP 284 292A and EP 303 520A (Kao) are also of interest.

The bleach system can be either supplemented with or replaced by a peroxyacid. Examples of such peracids can be found in U.S. Pat. No. 4,686,063 and U.S. Pat. No. 5,397,501 (Unilever). A preferred example is the imido peroxycarboxylic class of peracids described in EP A 325 288, EP A 349 940, DE 382 3172 and EP 325 289. A particularly preferred example is phthalimido peroxy caproic acid (PAP). Such peracids are suitably present at 0.1-12%, preferably 0.5-10%.

A bleach stabiliser (transition metal sequestrant) may also be present. Suitable bleach stabilisers include ethylenediamine tetra-acetate (EDTA), the polyphosphonates such as Dequest (Trade Mark) and non-phosphate stabilisers such as EDDS (ethylene diamine di-succinic acid). These bleach stabilisers are also useful for stain removal especially in products containing low levels of bleaching species or no bleaching species.

An especially preferred bleach system comprises a peroxy bleach compound (preferably sodium percarbonate optionally together with a bleach activator), and a transition metal bleach catalyst as described and claimed in EP 458 397A, EP 458 398A and EP 509 787A (Unilever).

Bleach systems may comprise transition metal catalyst systems such as those disclosed in WO9965905; WO0012667; WO0012808; WO0029537, and, WO0060045. These catalyst systems have the advantage that they require no added peroxyl compounds and can work, directly or indirectly, using atmospheric oxygen.

The compositions according to the invention may also contain one or more enzyme(s). Suitable enzymes include the proteases, amylases, cellulases, oxidases, peroxidases and lipases usable for incorporation in detergent compositions.

Preferred proteolytic enzymes (proteases) are, catalytically active protein materials which degrade or alter protein types of stains when present as in fabric stains in a hydrolysis reaction. They may be of any suitable origin, such as vegetable, animal, bacterial or yeast origin.

Proteolytic enzymes or proteases of various qualities and origins and having activity in various pH ranges of from 4-12 are available and can be used in the instant invention. Examples of suitable proteolytic enzymes are the subtilisins which are obtained from particular strains of *B. Subtilis B. licheniformis*, such as the commercially available subtilisins Maxatase (Trade Mark), as supplied by Genencor International N.V., Delft, Holland, and Alcalase (Trade Mark), as supplied by Novozymes Industri A/S, Copenhagen, Denmark.

Particularly suitable is a protease obtained from a strain of *Bacillus* having maximum activity throughout the pH range of 8-12, being commercially available, e.g. from Novozymes Industri A/S under the registered trade-names Esperase (Trade Mark) and Savinase (Trade-Mark). The preparation of these and analogous enzymes is described in GB 1 243 785. Other commercial proteases are Kazusase (Trade Mark obtainable from Showa-Denko of Japan), Optimase (Trade Mark from Miles Kali-Chemie, Hannover, West Germany), and Superase (Trade Mark obtainable from Pfizer of U.S.A.).

Detergency enzymes are commonly employed in granular form in amounts of from about 0.1 to about 3.0 wt %. However, any suitable physical form of enzyme may be used.

The combination of non-cellulose polysaccharides and cellulase enzymes is particularly useful, as these enzymes exhibit reduced activity against this class of polysaccharides, as compared to their activity against cellulose. Cellulase is known to be useful and is used in laundry products for defuzzing and colour brightening.

The compositions of the invention may contain alkali metal (preferably sodium) carbonate, in order to increase detergency and ease processing. Sodium carbonate may suitably be present in amounts ranging from 1 to 60 wt %, preferably from 2 to 40 wt %. However, compositions containing little or no sodium carbonate are also within the scope of the invention.

Powder flow may be improved by the incorporation of a small amount of a powder structurant, for example, a fatty acid (or fatty acid soap), a sugar, an acrylate or acrylate/maleate copolymer, or sodium silicate. One preferred powder structurant is fatty acid soap, suitably present in an amount of from 1 to 5 wt %.

Other materials that may be present in detergent compositions of the invention include sodium silicate; anti-redeposition agents such as cellulosic polymers; soil release polymers; inorganic salts such as sodium sulphate; or lather boosters as appropriate; dyes; coloured speckles; fluorescers and de-coupling polymers. This list is not intended to be exhaustive. However, many of these ingredients will be better delivered as benefit agent groups in materials according to the first aspect of the invention.

The detergent composition when diluted in the wash liquor (during a typical wash cycle) will typically give a pH of the wash liquor from 7 to 10.5 for a main wash detergent.

Particulate detergent compositions are suitably prepared by spray-drying a slurry of compatible heat-insensitive ingredients, and then spraying on or post-dosing those ingredients unsuitable for processing via the slurry. The skilled detergent formulator will have no difficulty in deciding which ingredients should be included in the slurry and which should not.

Particulate detergent compositions of the invention preferably have a bulk density of at least 400 g/l, more preferably at least 500 g/l. Especially preferred compositions have bulk densities of at least 650 g/liter, more preferably at least 700 g/liter.

Such powders may be prepared either by post-tower densification of spray-dried powder, or by wholly non-tower methods such as dry mixing and granulation; in both cases a high-speed mixer/granulator may advantageously be used. Processes using high-speed mixer/granulators are disclosed, for example, in EP 340 013A, EP 367 339A, EP 390 251A and EP 420 317A (Unilever).

Liquid detergent compositions can be prepared by admixing the essential and optional ingredients thereof in any desired order to provide compositions containing components in the requisite concentrations. Liquid compositions according to the present invention can also be in compact form which means it will contain a lower level of water compared to a conventional liquid detergent.

Product Forms

Product forms include powders, liquids, gels, tablets, any of which are optionally incorporated in a water-soluble or water dispersible sachet. The means for manufacturing any of the product forms are well known in the art. If the SPSS and the FPSS-polysaccharide conjugate are to be incorporated in a powder (optionally the powder to be tableted), and whether or not pre-emulsified, they are optionally included in a separate granular component, e.g. also containing a water soluble organic or inorganic material, or in encapsulated form.

Substrate

The substrate may be any substrate onto which it is desirable to deposit FPSS and which is subjected to treatment such as a washing or rinsing process.

In particular, the substrate may be a textile fabric. It has been found that particular good results are achieved when using a natural fabric substrate such as cotton, or fabric blends containing cotton.

Treatment

The treatment of the substrate with the material of the invention can be made by any suitable method such as washing, soaking or rinsing of the substrate.

Typically the treatment will involve a washing or rinsing method such as treatment in the main wash or rinse cycle of a washing machine and involves contacting the substrate with an aqueous medium comprising the material of the invention.

EXAMPLES

The present invention will now be explained in more detail by reference to the following non-limiting examples.

In the following examples where percentages are mentioned, this is to be understood as percentage by weight. In the following tables where the values do not add up to 100 these are to be understood as parts by weight.

Example 1

Preparation of Locust Bean Gum Poly Dimethyl Siloxane Conjugate

Lithium chloride (27 g) was dissolved in anhydrous dimethyl sulfoxide (300 $cm^3$) with heating (150° C.) and stirring under nitrogen. Once the lithium chloride was dissolved the solution was cooled to 120° C. before slowly adding locust bean gum (3.5 g) over a period of 20 minutes with vigorous stirring.

The viscous solution thus obtained was then further cooled to 70° C. and carbonyl diimidazole (54 mg, 0.5 mmols) was added and stirring and heating was continued for a further two hours. Diaminopropyl terminated polydimethylsiloxane, 3,000 MWt, (1 g, 0.33 mmols) was then added and the solution stirred with heating for 18 hours.

The solution was cooled to room temperature before adding drop-wise to vigorously stirring acetone (3 liters) to precipitate the polymer. The solution was centrifuged to isolate the product which was then washed with acetone (2×200 $cm^3$) before drying under vacuum (40° C.) overnight to give an off-white solid (3.1 g).

From the 1H NMR of the hydrolysed product (heated to 1 hour at 70° C. in 20% $DCl/D_2O$) the degree of substitution of PDMS groups to sugar units was found to be $5.3\times10^{-4}$.

Example 2

Preparation of Aminosilicone Emulsion I

Emulsions were prepared as using the formulations shown in Table 1.

TABLE 1

| Ingredient | Parts | |
|---|---|---|
| | Example 2 | Control 2A |
| Polymer A (from Example 1) | 10 | 0 |
| Synperonic A7* | 3 | 13 |
| Q2-8220# | 100 | 100 |
| Water | 10000 | 10000 |

*Synperonic A7 ™ is a dodecane hexaethoxylate nonionic surfactant
#Q2-8220 ™ is an aminosilicone oil from Dow Corning. Its viscosity was measured as 160 mPas with a "Bohlin CV 120 High Resolution" viscometer at 22° C. and a shear rate of 100 $s^{-1}$ using the cone and plate method.

Polymer A and Synperonic A7 were weighed into a bottle along with the required amount of water. This mixture was agitated using an ultrasonic probe (Soniprobe™) at half power until no undissolved Polymer A is visible (2-3 minutes) The Q2-8220 was then added to the bottle. The mixture was sheared using a Silverson™ L4R high shear mixer fitted with a 25 mm diameter shearing head and a square-hole, high shear screen at setting 5 for four minutes.

Example 3

Treatment of Fabrics

Wash liquors were prepared by adding 4.47 g of the formulations given in Table 2 to 150 $cm^3$ of water.

TABLE 2

| Ingredient | Quantity/% | |
|---|---|---|
| | Example 3 | Control 3A |
| Sodium LAS spray-dried 100% | 1.72 | 1.72 |
| Nonionic 7EO, branched | 1.34 | 1.34 |
| Zeolite A24 | 4.07 | 4.07 |
| sodium carbonate light | 3.38 | 3.38 |
| Copolymer CP5 | 0.22 | 0.22 |
| sodium sulphate | 2.01 | 2.01 |
| sodium silicate | 0.20 | 0.20 |
| Soap | 0.31 | 0.31 |
| sodium carboxymethyl cellulose | 0.04 | 0.04 |
| silicone antifoam | 0.25 | 0.25 |
| Fluorescer | 0.16 | 0.16 |
| Carbonate/Disilicate cogranule | 0.65 | 0.65 |
| Dequest 2016 | 0.09 | 0.09 |
| Dequest 2047 | 0.13 | 0.13 |
| TAED | 0.54 | 0.54 |
| sodium percarbonate | 2.57 | 2.57 |
| Citric acid anhydrous | 0.49 | 0.49 |
| Savinase 12.0TX | 0.09 | 0.09 |
| Thermamyl 60 T | 0.07 | 0.07 |
| Carezyme | 0.04 | 0.04 |
| Perfume | 0.07 | 0.07 |
| Moisture, salts, NDOM | 1.03 | 1.03 |
| Emulsion Example 2 | 80.52 | 0.000 |
| Emulsion Control 2A | 0.000 | 80.52 |

The wash liquors were placed in separate pots of a Rotawash™ Colour Fastness Tester (ex SDL, UK and as described in ISO 105) that had been preheated to 40° C. To each pot was added a piece of white 100% cotton sheeting (ex Phoenix Calico, UK) weighing 18 g along with 25 stainless steel balls. The pots were sealed and then washed for 45 minutes with end over end agitation at 40 rpm. At the end of the wash period, the liquor was decanted from each of the pots, which were then refilled with 250 $cm^3$ of water, resealed, replaced in the Rotawash and washed for a further ten minutes. The rinse step was repeated one more time after which, the rinse liquor was decanted from the pots, the cloths gently squeezed by hand to remove excess water and the fabrics dried flat overnight under ambient conditions.

The quantity of aminosilicone deposited onto the fabrics during the wash was then determined as follows. Each fabric piece was cut into three and the individual pieces weighed. Each fabric piece was added to a bottle containing 50 $cm^3$ of tetrahydrofuran (THF) and the deposited silicone extracted with the aid of ultrasonication for five minutes. The amount of aminosilicone extracted was determined by gel permeation chromatography (GPC) using a PLgel HTS-F column with THF eluent and an evapourative light scattering detector ELS 1000 light scattering detector. The area under the elution peak for the aminosilicone was calculated by integration of the trace and this area was used to calculate the concentration of aminosilicone in the THF solution from the extraction by comparison to a calibration curve produced using aminosilicone in THF standards. The results from the three portions of cloth were used to calculate an average value for the amount of aminosilicone deposited on the fabric expressed as milligrams of aminosilicone deposited per gram of fabric. These results are tabulated below in Table 3.

TABLE 3

| | Aminosilicone deposited/ mg per g of fabric | |
|---|---|---|
| | Example 3 | Control 3A |
| Replicate 1 | 0.77 ± 0.04 | 0.036 ± 0.009 |
| Replicate 2 | 0.78 ± 0.08 | 0.039 ± 0.006 |

Example 4

Preparation of Aminosilicone Emulsion II

Emulsions were prepared using the formulations shown in Table 4.

TABLE 4

| | Parts | |
|---|---|---|
| Ingredient | Example 4 | Control 4A |
| Polymer A (from Example 1) | 10 | 0 |
| Synperonic A7* | 3 | 13 |
| Rhodorsil huile Extrasoft# | 100 | 100 |
| Water | 900 | 900 |

*Synperonic A7 ™ is a dodecane hexaethoxylate nonionic surfactant
#Rhodorsil huile Extrasoft ™ is an aminosilicone oil from Rhodia. Its viscosity was measured as ca. 6000 mPas with a "Bohlin CV 120 High Resolution" viscometer at 20° C. and a shear rate of 100 $s^{-1}$ using the cone and plate method.

Polymer A and Synperonic A7 were weighed into a bottle along with the required amount of water. This mixture was agitated using an ultrasonic probe (Soniprobe™) at half power until no undissolved Polymer A is visible (3×1 minute periods) The Rhodorsil huile Extrasoft™ was then added to the bottle. The mixture was sheared using a Silverson™ L4R high shear mixer fitted with a 25 mm diameter shearing head and a square-hole, high shear screen. The mixer was set at full speed (approximately 6000 rpm) for five minutes at room temperature.

Example 5

Treatment of Fabrics in Washing Machine

Representative washloads as detailed in Table 5 were placed in each of two Computer controlled Miele Front loading automatic washing machines.

TABLE 5

| Fabric | Weight/g |
|---|---|
| 100% cotton terry towelling | 371 |
| 100% cotton interlock | 587 |
| 100% cotton sheeting | 404 |
| 65:35 polyester/cotton sheeting | 534 |
| 100% knitted polyester | 589 |

To the dosing drawer of each machine was added 87 g of the detergent powder formulation given in Table 6. The emulsion samples were introduced into the machines via a spherical plastic dosing ball. 25 g of Example 4 and 50 g of Control 4A were placed in separate dosing balls and these were placed on top of the washloads in the washing machine. The machines were set running with identical conditions of: standard cotton cycle; 40° C. wash temperature; 15 liter intake of normal tap water of about 15° French Hardness. At the end of the wash cycle, the fabrics were line dried indoors under ambient conditions. When dry, four samples of fabric were cut randomly from each of the fabric types included in the wash and were analysed for deposited silicone using the extraction and GPC method described in Example 3. The results of this extraction were used to calculate the amount of aminosilicone deposited onto the fabric as milligrams of aminosilicone per gram of fabric. Knowing the overall composition of the wash load, the total amount of silicone deposited onto fabric was calculated. This was then expressed as the percentage of the aminosilicone added to the wash liquor that ended up deposited on the washload. These results are given in Table 7. It is clear that even though less aminosilicone was added to the wash liquor in Example 4 compared to Control 4A, Example 4 resulted in almost twice as much aminosilicone being deposited onto the fabric—this represents a fourfold increase in the deposition efficiency.

TABLE 6

| Ingredient | Quantity/% |
|---|---|
| Sodium LAS spray-dried 100% | 8.83 |
| Nonionic 7EO, branched | 6.88 |
| Zeolite A24 | 20.90 |
| sodium carbonate light | 17.36 |
| Copolymer CP5 | 1.13 |
| sodium sulphate | 10.32 |
| sodium silicate | 1.03 |
| Soap | 1.59 |
| sodium carboxymethyl cellulose | 0.21 |
| silicone antifoam | 1.28 |
| Fluorescer | 0.82 |
| Carbonate/Disilicate cogranule | 3.34 |
| Dequest 2016 | 0.46 |
| Dequest 2047 | 0.67 |
| TAED | 2.77 |

TABLE 6-continued

| Ingredient | Quantity/% |
|---|---|
| sodium percarbonate | 13.20 |
| Citric acid anhydrous | 2.52 |
| Savinase 12.0TX | 0.46 |
| Thermamyl 60 T | 0.36 |
| Carezyme | 0.21 |
| Perfume | 0.36 |
| Moisture, salts, NDOM | 5.29 |

TABLE 7

| | Aminosilicone deposited/ mg per g of fabric | |
|---|---|---|
| Fabric | Example 4 | Control 4A |
| 100% cotton terry towelling | 0.34 ± 0.13 | 0.16 ± 0.05 |
| 100% cotton interlock | 0.16 ± 0.01 | 0.29 ± 0.04 |
| 100% cotton sheeting | 0.23 ± 0.06 | 0.01 ± 0.00 |
| 65:35 polyester/cotton sheeting | 0.32 ± 0.06 | 0.02 ± 0.00 |
| 100% knitted polyester | 0.02 ± 0.01 | 0.02 ± 0.00 |
| Total amino silicone deposited/g | 0.50 | 0.26 |
| percentage of total aminosilicone deposited | 19.8% | 5.12% |

The invention claimed is:

1. A water-soluble or dispersible, non-hydrolysable polysaccharide (NHP), having at least one first polymeric textile benefit species bonded thereto by a hydrolytically stable bond and a second textile benefit species which is not covalently bonded thereto wherein the second textile benefit species is a second polymeric textile softening species (SPSS) and wherein the SPSS is a silicone having a dynamic viscosity of >2,500 mPa·s.

2. A composition according to claim 1 wherein the first polymeric textile benefit species is a first polymeric textile softening species (FPSS).

3. A composition according to claim 2 wherein the bond between the FPSS and the polysaccharide is such that the decay rate constant ($K_d$) of the material in an aqueous solution at 0.01 wt % of the material together with 0.1 wt % of anionic surfactant at a temperature of 40° C. at a pH of 10.5 is such that $k_d<10^{-3}s^{-1}$.

4. A composition according to claim 1 wherein the NHP has a backbone comprising $\beta_{1-4}$ linkages.

5. A composition according to claim 4 wherein the NHP is a poly-glucan, poly-mannan, gluco-mannan or a mixture thereof.

6. A composition according to claim 5 wherein the NHP is a galacto-mannan, xyloglucan or a mixture thereof.

7. A composition according to claim 6 wherein the NHP is locust bean gum, tamarind xyloglucan, guar gum or mixture thereof.

8. A composition according to claim 2 wherein first polymeric textile softening species (FPSS) is a silicone.

9. A composition according to claim 2 wherein the ratio of the NHP with the FPSS bonded thereto to the SPSS is in the range 1:100 to 1:5 parts by weight.

10. A composition as claimed in claim 1 comprising NHP with FPSS bonded thereto, and optionally SPSS, as the dispersed phase of an emulsion.

11. A composition as claimed in claim 10 further comprising an emulsifying agent.

12. A composition as claimed in claim 11 wherein the emulsifying agent comprises a non-ionic surfactant.

13. A composition as claimed in claim 10 wherein the emulsion is 30 to 99.9% of a polar solvent.

14. A composition as claimed in claim 2 wherein the FPSS is a silicone selected from polydialkyl siloxanes, amine derivatives thereof, and mixtures thereof.

15. A composition as claimed in claim 14, wherein the silicone chain(s) on the substituted polysaccharide have an average degree of substitution of from 0.001 to 0.5.

16. A composition as claimed in claim 14, wherein the silicone chain(s) in the substituted polysaccharide is or are independently selected from those of formula:

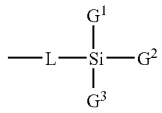

wherein L is absent or is a linking group and one or two of substituents $G^1$-$G^3$ is a methyl group, the remainder being selected from groups of formula

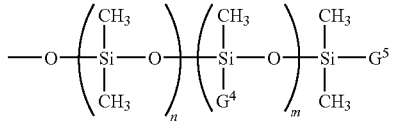

the $—Si(CH_3)_2O—$ groups and the $—Si(CH_30)(G^4)—$ groups being arranged in random or block fashion, wherein n is from 5 to 1000, and m is from 0 to 100, $G^4$ is selected from groups of formula:

$—(CH_2)_p—CH_3$, where p is from 1 to 18

$—(CH_2)_q—NH—(CH_2)_r—NH_2$ where q and r are independently from 1 to 3

$—(CH_2)_s—NH_2$, where s is from 1 to 3

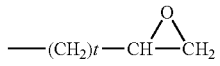

where t is from 1 to 3

$—(CH_2)_u—COOH$, where u is from 1 to 10,

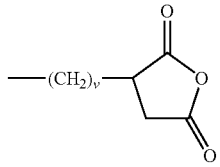

where v is from 1 to 10, and $—(CH_2CH_2O)_w—(CH_2)_xH$, where w is from 1 to 150, and x is from 0 to 10;

and $G^5$ is independently selected from hydrogen, groups defined above for $G^4$, —OH, $—CH_3$ and $—C(CH_3)_3$.

17. A composition as claimed in claim 16, where L is selected from amide linkages, ester linkages, ether linkages, urethane linkages, triazine linkages, carbonate linkages, amine linkages and ester-alkylene linkages.

18. A laundry treatment composition comprising a composition as claimed in claim 1 and at least one further component.

19. A laundry treatment composition as claimed in claim 18, wherein the further component comprises a surfactant.

20. A method for enhancing the softening benefit of a laundry treatment composition on a substrate comprising the step of contacting the substrate with the laundry treatment composition containing the composition of claim 1.

* * * * *